US006162014A

United States Patent [19]

Bagepalli et al.

[11] Patent Number: 6,162,014

[45] Date of Patent: Dec. 19, 2000

[54] TURBINE SPLINE SEAL AND TURBINE ASSEMBLY CONTAINING SUCH SPLINE SEAL

[75] Inventors: Bharat Sampathkumar Bagepalli, Niskayuna; Sami Aslam, Clifton Park; Leslie Boyd Bedell, Niskayuna; Mahmut Faruk Aksit, Troy, all of N.Y.

[73] Assignee: General Electric Company, Schenectady, N.Y.

[21] Appl. No.: 09/158,738

[22] Filed: Sep. 22, 1998

[51] Int. Cl.[7] ..... F01D 5/00

[52] U.S. Cl. ..... 415/170.1; 415/174.2; 415/138; 415/139; 277/630; 277/643; 277/651; 277/652

[58] Field of Search ..... 415/135, 138, 415/139, 170.1, 173.7, 174.2; 277/630, 637, 643, 651, 652, 654

[56] References Cited

U.S. PATENT DOCUMENTS 5,221,096 6/1993 Heldreth et al. ..... 277/630
5,509,669 4/1996 Wolfe et al. .
5,586,773 12/1996 Bagepalli et al. .
5,657,998 8/1997 Dinc et al. .

OTHER PUBLICATIONS

See enclosed single–page "Applicants' Statement".

*Primary Examiner*—Edward K. Look
*Assistant Examiner*—Liam McDowell
*Attorney, Agent, or Firm*—Douglas E. Erickson; Marvin Snyder

[57] ABSTRACT

A turbine spline seal includes an elongated turbine seal member. The seal member has an elongated, imperforate, and manually-flexible first portion and a manually-rigid second portion lengthwise adjoining the first portion. The turbine assembly includes the turbine spline seal and also includes first and second turbine members. The first and second turbine members are spaced apart to define a fluid-path leakage gap therebetween, and the seal member is placed in the gap. Each lengthwise edge of the seal member engages a respective one of two opposing surface grooves of the first and second turbine members.

20 Claims, 6 Drawing Sheets

TURBINE SPLINE SEAL AND TURBINE ASSEMBLY CONTAINING SUCH SPLINE SEAL

FIELD OF THE INVENTION

The present invention relates generally to seals, and more particularly to a spline seal for a turbine.

BACKGROUND OF THE INVENTION

Turbine assemblies include, without limitation, turbine sections of steam turbines and compressor and/or turbine sections of gas turbines. A steam turbine has a steam path which typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Gas or steam leakage, either out of the gas or steam path or into the gas or steam path, from an area of higher pressure to an area of lower pressure, is generally undesirable. For example, gas-path leakage in the turbine or compressor area of a gas turbine, between the rotor of the turbine or compressor and the circumferentially surrounding turbine or compressor casing, will lower the efficiency of the gas turbine leading to increased fuel costs. Additionally, gas-path leakage in the combustor area of a gas turbine will require an increase in burn temperature to maintain power level, such increased burn temperature leading to increased pollution, such as increased NOx and CO production. Also, steam-path leakage in the turbine area of a steam turbine, between the rotor of the turbine and the circumferentially surrounding casing, will lower the efficiency of the steam turbine leading to increased fuel costs.

Seals are used to minimize leakage of fluids. A known fluid-path leakage seal is a cloth seal having a generally impervious and uniformly-thick shim assemblage and a cloth assemblage generally surrounding the shim assemblage. Cloth seals may be used in many applications including, but not limited to, seal assemblies for steam turbines and gas turbines used for power generation and seal assemblies for gas turbines used for aircraft and marine propulsion.

Another known fluid-path leakage seal is a manually-rigid metal seal for sealing the gap between two circumferentially-adjacent (and non-rotating) transition pieces of a power-system gas turbine. Such metal seal has a uniform thickness and has the general shape of an elongated rectangular metal bar. One elongated edge of the metal bar is engaged in a surface groove of one transition piece. The other elongated edge of the metal bar is engaged in a matching and aligned surface groove of the other transition piece. One end of the metal bar serves as a mounting bracket, typically having a mounting guide hole and a right-angle bend, which is used to secure the seal to a (non-rotating) first-stage nozzle. The grooves of transition pieces are not perfectly machined, and the grooves of transition pieces installed in power-system gas turbines are not perfectly aligned. Under actual field conditions during turbine maintenance downtime, it typically takes several days to replace all of such transition-piece metal seals in a standard power-system gas turbine. It is not unusual for such metal seals to break after only 100 to 4,000 hours of turbine operation. It is known that liberated pieces of broken metal seals have damaged other components of the turbine, such as rotating turbine blades downstream of the first-stage nozzle. Shutting down a power-system gas turbine to replace a broken seal is a costly undertaking in terms of lost electrical-generating capacity.

SUMMARY OF THE INVENTION

The turbine spline seal of the present invention includes an elongated turbine seal member having an elongated, imperforate, and manually-flexible first portion and a manually-rigid second portion lengthwise adjoining the first portion. The first portion is lengthwise located between the seal member's first end and the second portion. The second portion is lengthwise located between the first portion and the seal member's second end, and the second portion lengthwise extends near the second end.

The turbine assembly of the present invention includes a first turbine member, a second turbine member located near and spaced apart from the first turbine member so as to define a fluid-path leakage gap, and the turbine spline seal described in the previous paragraph. The first turbine member has a first surface groove, and the second turbine member has a second surface groove facing and generally aligned with the first surface groove. The turbine spline seal has first and second edges bounding its width. The turbine seat member is positioned in the gap with the first edge engaged in the first surface groove and with the second edge engaged in the second surface groove. The turbine spline seal is vibrationally excited within a range of vibrational frequencies by motion of generally only the first and second turbine members during operation of the turbine, and the turbine spline seal is devoid of any resonant frequency within the range of vibrational frequencies. In one example, the second portion of the turbine seal member defines or includes a mounting bracket which is secured to a third turbine member. In an exemplary application, the turbine assembly is a power-system gas turbine assembly, the first and second turbine members are circumferentially-adjacent transition pieces, and the third turbine member is a first stage nozzle.

Several benefits and advantages are derived from the invention. The manually-flexible first portion of the turbine seal member allows all transition-piece turbine spline seals in a standard power-system gas turbine to be replaced in generally half a day instead of the several days required for prior-art seals. Applicants discovered that such prior-art seals had a dominant resonant frequency which was excited by the vibration (including twisting) motion of the transition pieces leading to early seal failure. The manually-rigid second portion of the turbine seal member of applicants' turbine spline seal has its length and thickness chosen, as can be appreciated by those skilled in the art, to avoid the installed turbine spline seal from having any resonant frequencies which can be excited by the vibrational motion of the transition pieces during operation of the turbine. A continuing test is showing the potential for turbine spline seals of the invention for holding up at over 12,000 hours of turbine operation compared to typical prior-art seal failures at between 100 and 4,000 hours of turbine operation.

DETAILED DESCRIPTION OF THE INVENTION

Figure 1:
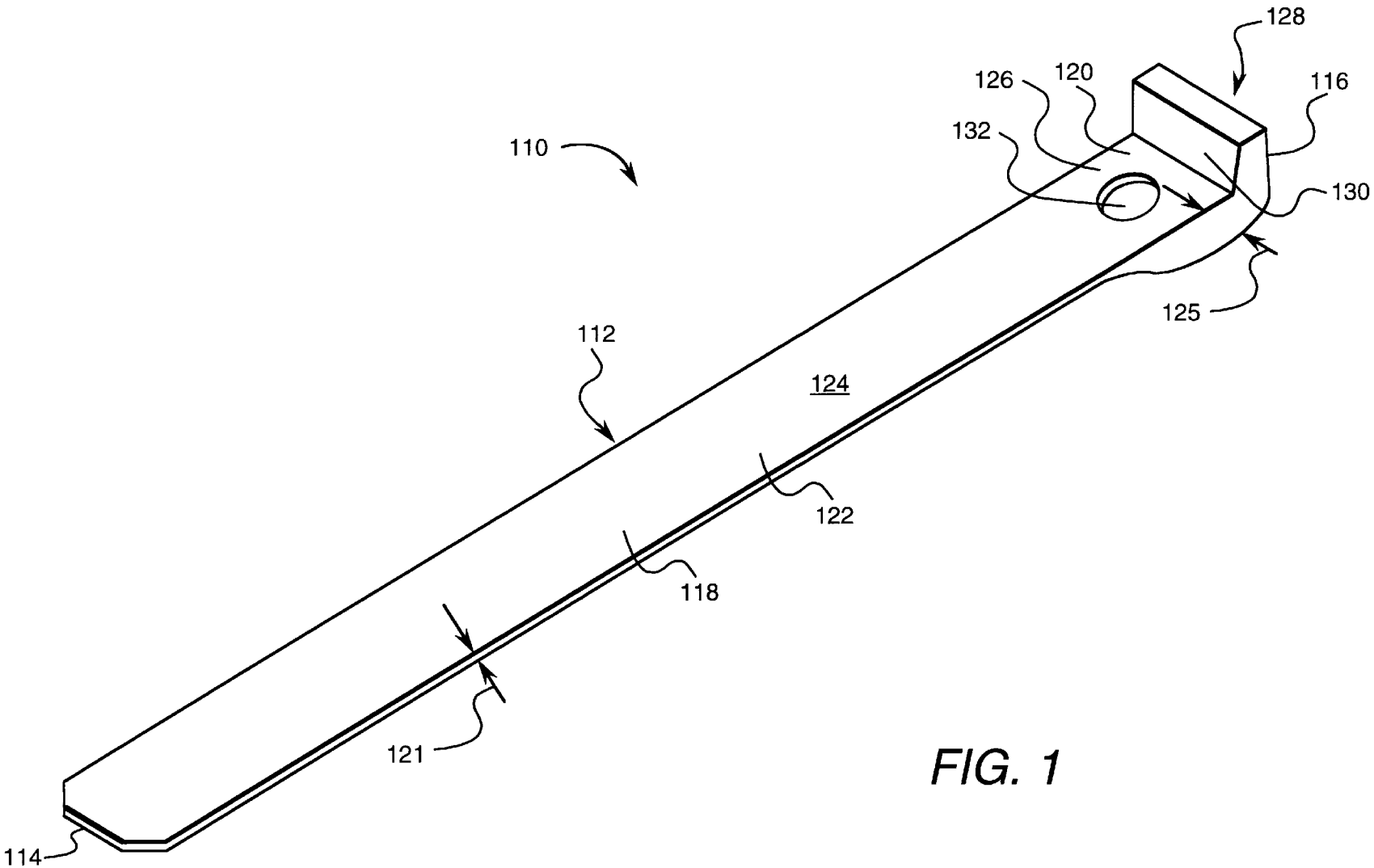
FIG. 1 is a perspective view of a first embodiment of the turbine spline seal of the present invention.

Referring now to the drawings, wherein like numerals represent like elements throughout, FIG. 1 shows a first embodiment of the turbine spline seal 110 of the present invention. The turbine spline seal 110 includes an elongated turbine seal member 112 having a length and having opposing first and second ends 114 and 116. The turbine seal member 112 includes an elongated, imperforate, and manually-flexible first portion 118 and also includes a manually-rigid second portion 120 lengthwise adjoining the first portion 118. By "manually-flexible" is meant that the first portion 118 can be flexed by hand by an adult person of average strength. By "manually-rigid" is meant that the second portion 120 cannot be flexed by hand by an adult person of average strength. The first portion 118 is lengthwise disposed between the first end 114 and the second portion 120, the second portion 120 is lengthwise disposed between the first portion 118 and the second end 116, and the second portion 120 lengthwise extends proximate the second end 116.

It is preferred, but not required, that the turbine spline seal 110 have one or more of the characteristics hereinafter described in this paragraph. In the first embodiment, as seen in FIG. 1, the first portion 118 lengthwise extends proximate the first end 114. Here, the first portion 118 has a first thickness 121 and consists essentially of a first section 122 of a metal strip 124, and the second portion 120 has a second thickness 125 and consists essentially of a second section 126 of the metal strip 124. The second thickness 125 is at least five times greater than the first thickness 121, the second section 126 lengthwise adjoins the first section 122, and the metal strip 124 consists essentially of the first and second sections 122 and 126. In this construction, the metal strip 124 is a monolithic metal strip. The term "metal" includes elemental metals, alloys, and mixtures thereof. The second portion 120 defines a mounting bracket 128, the second portion 120 includes a right-angle bend 130, and the mounting bracket 128 is an angled mounting bracket. The second portion 120 has a mounting guide hole 132 lengthwise disposed between the first portion 118 and the second end 116.

Figures 2, 3, 4:
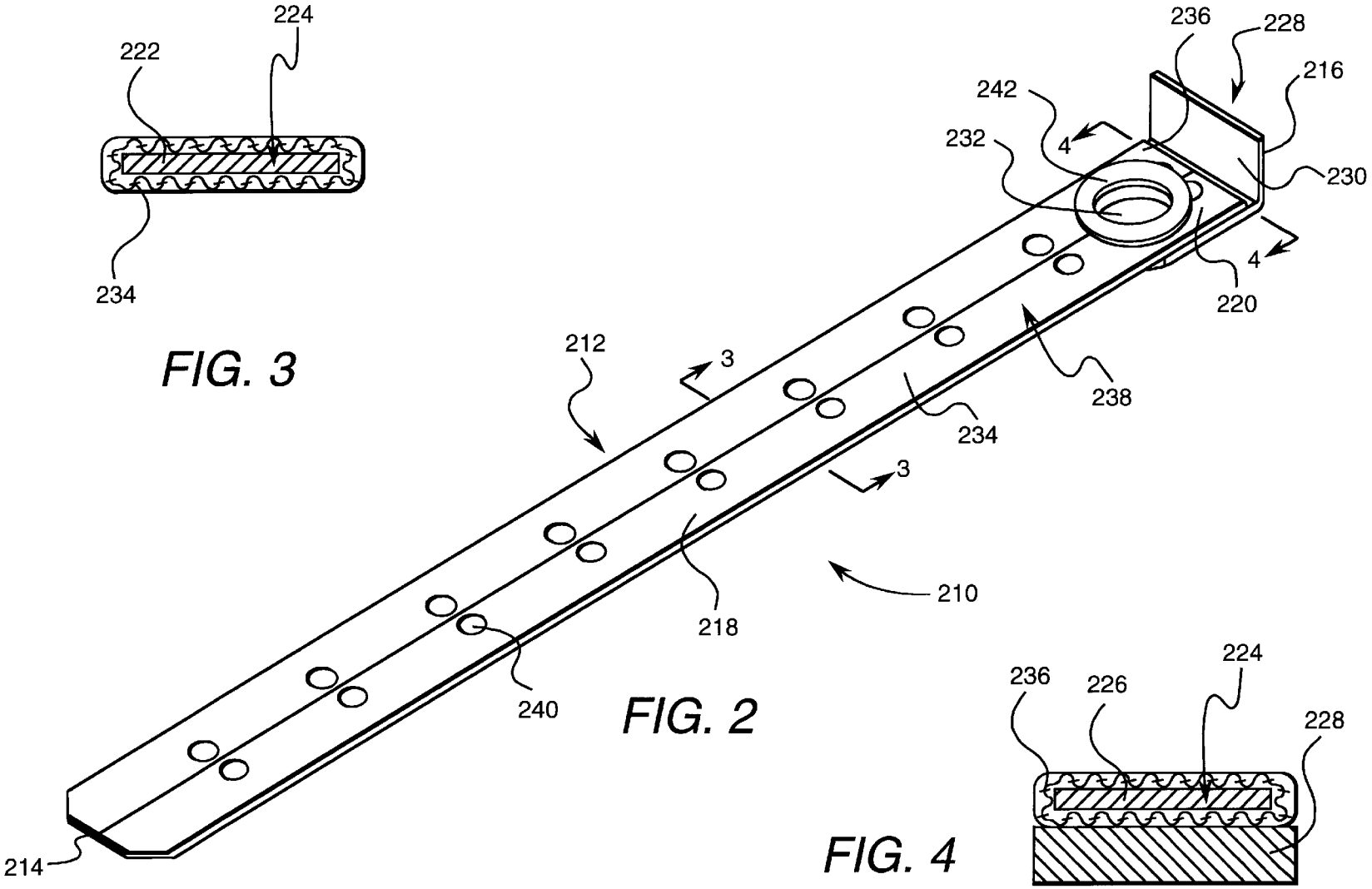
FIG. 2 is a perspective view of a second embodiment of the turbine spline seal of the present invention.
FIG. 3 is a cross-sectional view of the seal of FIG. 2 taken along lines 3—3 of FIG. 2.
FIG. 4 is a cross-sectional view of the seal of FIG. 2 taken along lines 4—4 of FIG. 2.

In a second embodiment of the turbine spline seal 210 of the present invention, as seen in FIG. 2, the turbine spline seal 210 includes an elongated turbine seal member 212 having a length and having opposing first and second ends 214 and 216. The turbine seal member 212 includes an elongated, imperforate, and manually-flexible first portion 218 and also includes a manually-rigid second portion 220 lengthwise adjoining the first portion 218. The first portion 218 is lengthwise disposed between the first end 214 and the second portion 220, the second portion 220 is lengthwise disposed between the first portion 218 and the second end 216, and the second portion 220 lengthwise extends proximate the second end 216.

It is preferred, but not required, that the turbine spline seal 210 have one or more of the characteristics hereinafter described in this and the following three paragraphs. In the second embodiment, as seen in FIGS. 2–4, the first portion 218 lengthwise extends proximate the first end 214. Here, the first and second portions 218 and 220 include adjoining sections 222 and 226 of an imperforate shim-layer assemblage 224 and adjoining sections 234 and 236 of a cloth-layer assemblage 238 which generally surrounds and is attached to the shim-layer assemblage 224.

The shim-layer assemblage 224 comprises at least one layer of shim (as shown in FIGS. 3 and 4). The shim-layer assemblage 224 may comprise at least two superimposed and preferably identical layers of shim having staggered slots for added flexibility. Each shim layer comprises (and preferably consists essentially of) a metal, ceramic, and/or polymer sheet. The choice of materials for the shim and the choice of the thickness for a shim layer are made by the artisan to meet the sealing, flexibility, and resilience requirements of a particular seal application. Typically, the shim-layer assemblage 224 has no more than four layers of shim. Usually, the shim-layer assemblage 224 has a thickness of generally between one and twenty hundredths of an inch, and each shim layer comprises (and preferably consists essentially of) a high-temperature, cobalt-based super-alloy, such as Inconel-750 or HS-188. It is noted that the shim layers can comprise different materials and/or have different thicknesses depending on the particular seal application.

The cloth-layer assemblage 238 comprises at least one layer of cloth (as shown in FIGS. 3 and 4). The cloth-layer assemblage 238 may comprise at least two overlying layers of cloth. A cloth layer comprises (and preferably consists essentially on metal, ceramic, and/or polymer fibers which have been woven, knitted, or pressed into a layer of fabric. The choice of layer construction (i.e., woven, knitted, or pressed), the choice of materials for the cloth, and the choice of the thickness for a layer are made by the artisan to meet the wear resistance, flexibility, and sealing requirements of a particular seal application. Preferably, the cloth-layer assemblage 238 has no more than two layers of cloth. It is noted that such multiple cloth layers can comprise different materials, different layer construction (i.e., woven, knitted, or pressed) and/or have different thicknesses depending on the particular seal application. Preferably, each cloth layer is a woven cloth layer. An exemplary cloth-layer assemblage 238 is a Dutch Twill weave cloth assemblage comprising (and preferably consisting essentially of) a high-temperature, cobalt-based super-alloy, such as L-605 or Haynes-25. It is noted that the cloth-layer assemblage 238 is attached to the shim-layer assemblage 224 by spot welds 240, and that the first end 214 of the turbine seal member 212 is edge-welded and trimmed.

The first portion 218 of the turbine seal member 212 consists essentially of its corresponding sections 222 and 234 of the shim-layer and cloth-layer assemblages 224 and 238. The second portion 220 of the turbine seal member 212 includes a mounting bracket 228 lengthwise overlapping the corresponding section 236 of the cloth-layer assemblage 238 of the second portion 220 and attached (such as by welding) to the corresponding sections 236 and 226 of the cloth-layer and shim-layer assemblages 238 and 224 of the second portion 220. The shim-layer assemblage 224 has a first thickness, and the mounting bracket 228 has a second thickness. The second thickness is at least five times greater than the first thickness. The mounting bracket 228, which may be made of stainless steel, includes a generally right-angle bend 230. The second portion 220 has a mounting guide hole 232 through the mounting bracket 228 and through the corresponding sections 236 and 226 of the cloth-layer and shim-layer assemblages 238 and 224 of the second portion 220. The turbine spline seal 220 also includes a washer 242 which is generally coaxially aligned with the mounting guide hole 232 and which is attached to the corresponding sections 236 and 226 of the cloth-layer and shim-layer assemblages 238 and 224 of the second portion 220 pposite (i.e., on the opposite side of) the attachment of the mounting bracket 228 to the corresponding sections 236 and 226 of the cloth-layer and shim-layer assemblages 238 and 224 of the second portion 220.

Figure 5:
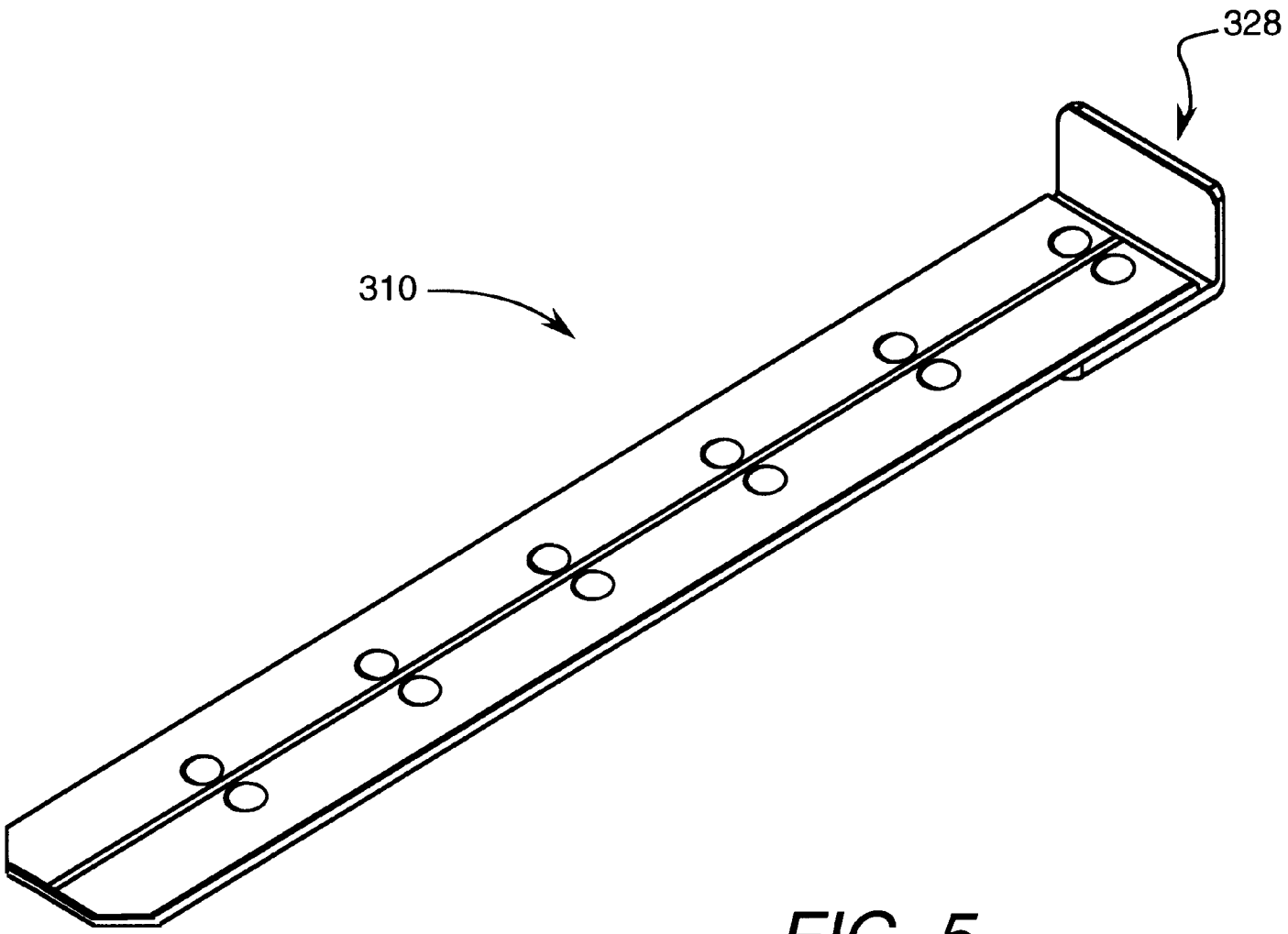
FIG. 5 is a perspective view of a third embodiment of the turbine spline seal of the present invention.

FIG. 5 shows a third embodiment of the turbine spline seal 310 of the present invention. Seal 310 is identical to seal 210 of the previously-described second embodiment with differences as hereinafter noted. In seal 310, the mounting guide hole 232 and the washer 242 of the second embodiment have been omitted.

Figure 6:
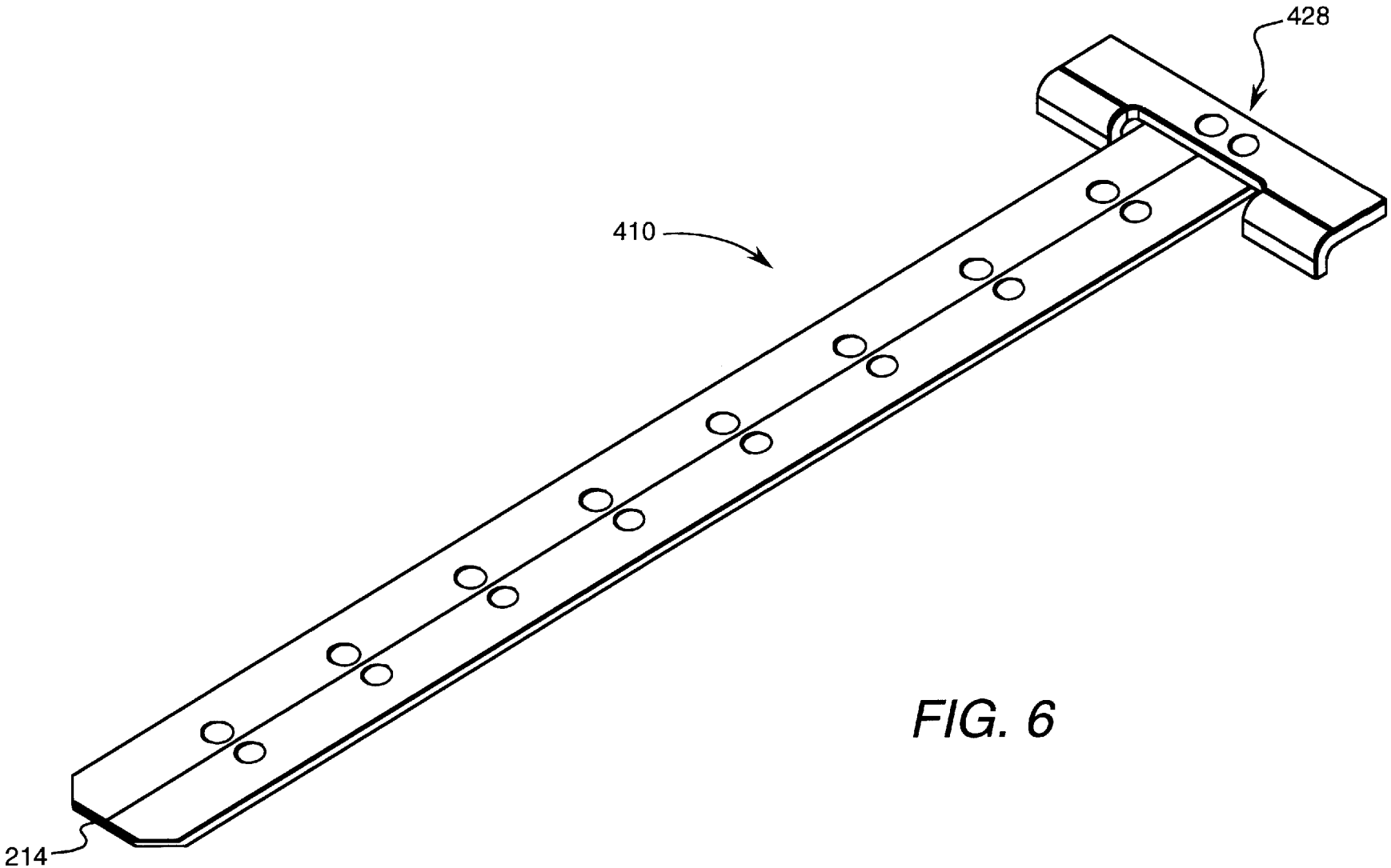
FIG. 6 is a perspective view of a fourth embodiment of the turbine spline seal of the present invention.

FIG. 6 shows a fourth embodiment of the turbine spline seal 410 of the present invention. Seal 410 is identical to seal 310 of the previously-described third embodiment with differences as hereinafter noted. In seal 410, the mounting bracket 328 of the third embodiment has been replaced with a winged (i.e., wider) mounting bracket 428 which provides for a larger bearing area of the seal 410 against adjacent turbine structure.

Figure 7:
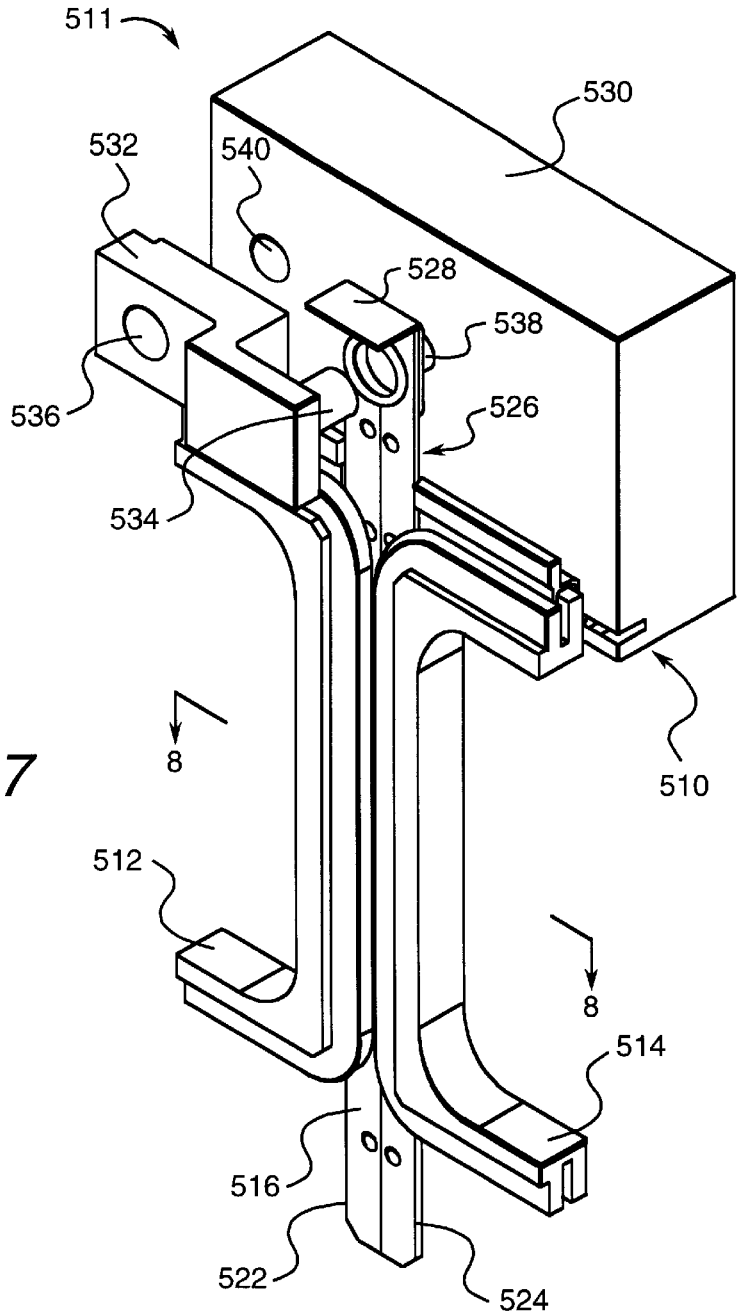
FIG. 7 is a schematic perspective view of a section of a turbine including a portion of a first embodiment of the turbine assembly of the present invention with a first mounting block about to secure the mounting bracket of the seal of FIG. 2 to the third turbine member.
Figure 8:
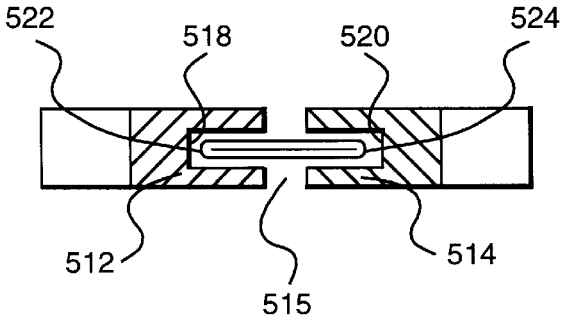
FIG. 8 is a cross-sectional view taken along lines 8—8 of FIG. 7 showing the edges of the turbine spline seal engaged in the surface grooves of the first and second turbine members.

Referring again to the drawings, FIGS. 7 and 8 show a first embodiment of the turbine assembly 510 of a turbine 511 of the present invention. Only a portion of the turbine 511 and turbine assembly 510 is shown in the figures. The turbine assembly 510 includes a first turbine member 512, a second turbine member 514 which is proximate and spaced apart from the first turbine member 512 so as to define a fluid-path leakage gap 515 therebetween, and a turbine spline seal 516. The first turbine member 512 has a first surface groove 518, and the second turbine member 514 has a second surface groove 520 facing and generally aligned with the first surface groove 518. A fluid-path leakage gap includes, without limitation, a steam-path leakage gap of a turbine of a steam turbine, a compressed-air leakage gap of a compressor of a gas turbine, and a combustion-gas leakage gap in or downstream of a combustor of a gas turbine. In a power-system gas turbine, downstream of the combustor includes the transition pieces, first-stage nozzle and turbine sections.

The turbine spline seal 516 is identical to the previously-described turbine spline seal 210 shown in FIGS. 2–4. Additional characteristics of the seal 516 and its installation in the rest of the turbine assembly 510 are hereinafter described. The turbine spline seal 516 has a width and opposing first and second edges 522 and 524 bounding the width. The turbine seal member 526 is disposed in the gap 515 with the first edge 522 engaged in the first surface groove 518 and with the second edge 524 engaged in the second surface groove 520. During operation of the turbine 51 1, the turbine spline seal 516 is vibrationally excited within a range of vibrational frequencies by motion of generally only the first and second turbine members 512 and 514. The turbine spline seal 516 is devoid of any resonant frequency within the range of vibrational frequencies, as is within the skill of the artisan to design by choosing, for example, an appropriate thickness and length of the mounting bracket 528.

It is preferred, but not required, that the turbine assembly 510 have one or more of the characteristics hereinafter described in this paragraph. The turbine assembly 510 also includes a third turbine member 530, and the mounting bracket 528 is secured to the third turbine member 530. In one application of the present invention, the turbine assembly 510 is a power-system gas turbine assembly, the first and second turbine members 512 and 514 are circumferentially-adjacent transition pieces of the gas turbine assembly, and the third turbine member 530 is a first stage nozzle of the gas turbine assembly. Here, the installed turbine seal member 526 is radially aligned, with the mounting bracket 528 located at its radially-outer end, and a mounting block 532 is used to secure the mounting bracket 528 to the third turbine member 530. The mounting block 532 has an alignment pin 534 and a bolt hole 536, and the third turbine member 530 has an alignment hole 538 and a threaded bolt hole 540. The alignment pin 534 of the mounting block 532 pass through the mounting guide hole of the turbine spline seal 516 and engages the alignment hole 538 of the third turbine member 530, and a bolt (not shown in the figures) passes through the bolt hole 536 in the mounting block 532 and threadably-engages the threaded bolt hole 540 of the third turbine member 530. It is noted that the mounting block 532 may be rotated a half turn about the alignment pin 534 for those seal positions on the third turbine member 530 wherein the threaded bolt hole 540 is to the right of the alignment hole 538.

Figure 9:
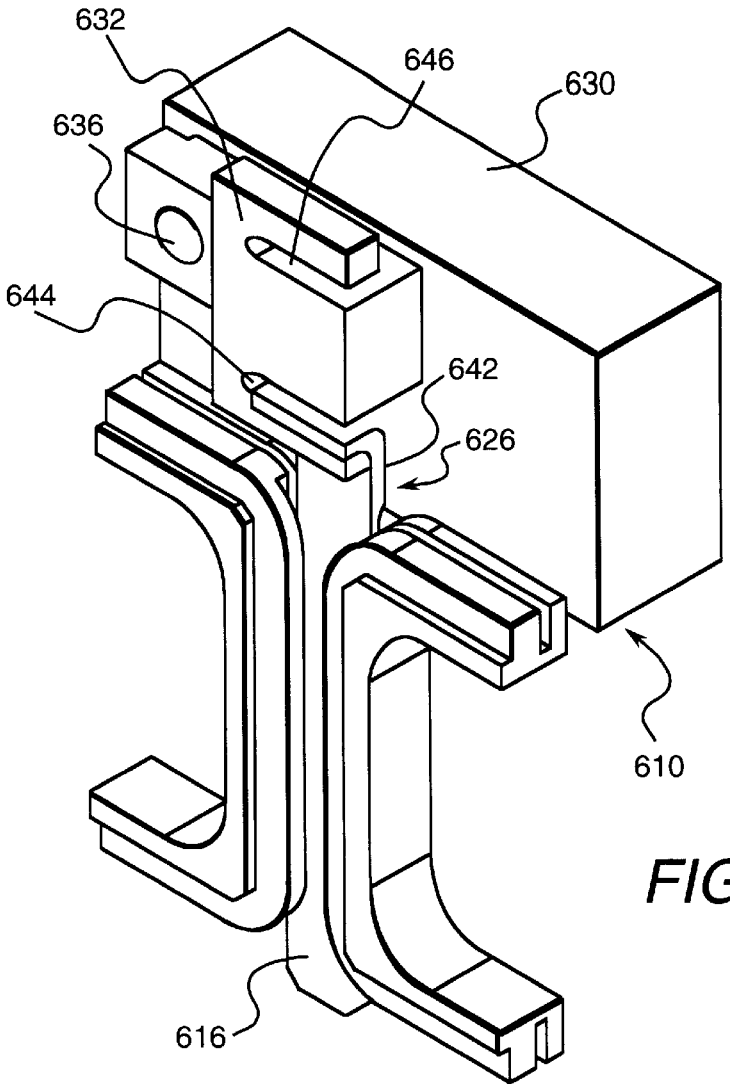
FIG. 9 is a schematic perspective view of a section of a turbine including a portion of a second embodiment of the turbine assembly of the present invention with a second mounting block securing the second portion of the seal of FIG. 1 to the third turbine member.
Figure 10:
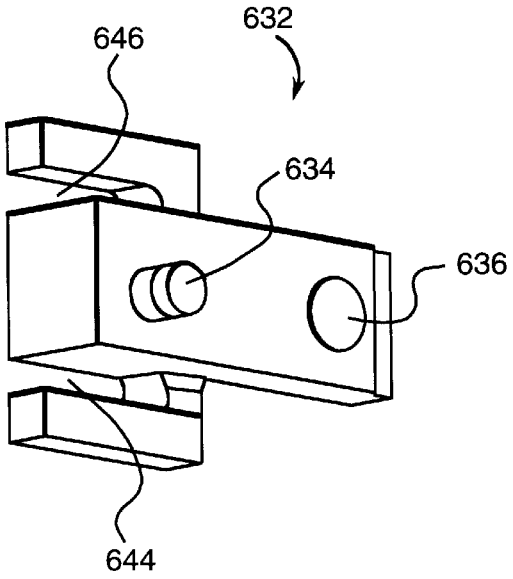
FIG. 10 is a different perspective view of the second mounting block of FIG. 9.

FIGS. 9 and 10 show a second embodiment of the turbine assembly 610 of the present invention. Turbine assembly 610 is identical to turbine assembly 510 of the previously-described first embodiment with differences as hereinafter noted. The turbine spline seal 616 of turbine assembly 610 is identical to the previously-described turbine spline seal 110 shown in FIG. 1. The second portion 642 of the turbine seal member 626 is secured to the third turbine member 630. Additional preferred, but not required, characteristics of the installation of the seal 616 in the rest of the turbine assembly 610 are hereinafter described. A different-shaped mounting block 632 is used. Mounting block 632 keeps the alignment pin 634 and bolt hole 636 and adds a first slot 644 and a second slot 646. The installation of mounting block 632 is similar to the installation of mounting block 532 except that here, the right-angle bend of the second portion 642 engages the first slot 644. It is pointed out that the first slot 644 is the lower slot in FIG. 9. It is noted that the mounting block 632 may be rotated a half turn about the alignment pin 634 for those seal positions on the third turbine member 630 wherein the threaded bolt hole is to the right of the alignment hole (such two holes being hidden in FIG. 9). As rotated, the second slot 646 becomes the lower slot for engagement with the right-angle bend of the second portion 642 of the turbine seal member 626.

As previously mentioned, the manually-flexible first portion of the turbine seal member allows all transition-piece turbine spline seals in a standard power-system gas turbine to be replaced in generally half a day instead of the several days required for prior-art seals. Applicants discovered that such prior-art seals had a dominant resonant frequency which was excited by the vibration (including twisting) motion of the transition pieces leading to early seal failure.

The manually-rigid second portion of the turbine seal member of applicants' turbine spline seal has its length and thickness chosen, as can be appreciated by those skilled in the art, to avoid the installed turbine spline seal from having any resonant frequencies which can be excited by the vibrational motion (typically between 80 and 200 Hertz) of the transition pieces during operation of the turbine. A continuing test of turbine spline seals like those shown in FIGS. 2–4 in turbine assemblies like those shown in FIGS. 7–8 shows the potential for turbine spline seals of the invention for holding up at over 12,000 hours of turbine operation compared to typical prior-art seal failures at between 100 and 4,000 hours of turbine operation. It is noted that a Dutch Twill weave will allow a small controlled leakage which provides cooling, as can be appreciated by the artisan.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A turbine spline seal comprising an elongated turbine seal member having a length and having opposing first and second ends bounding said length, wherein said turbine seal member includes an elongated, imperforate, and manually-flexible first portion, wherein said turbine seal member also includes a manually-rigid second portion lengthwise adjoining said first portion, wherein said first portion is lengthwise disposed between said first end and said second portion, wherein said second portion is lengthwise disposed between said first portion and said second end, wherein said second portion lengthwise extends proximate said second end, and wherein said turbine seal member lacks any manually-flexible portion and any manually-rigid portion which together define an intervening lengthwise-extending gap.

2. The turbine spline seal of claim 1, wherein said first portion lengthwise extends proximate said first end.

3. The turbine spline seal of claim 2, wherein said first portion has a first thickness and consists essentially of a first section of a metal strip, wherein said second portion has a second thickness and consists essentially of a second section of said metal strip, wherein said second thickness is at least five times greater than said first thickness, wherein said second section lengthwise adjoins said first section, and wherein said metal strip consists essentially of said first and second sections.

4. The turbine spline seal of claim 3, wherein said second portion defines a mounting bracket.

5. The turbine spline seal of claim 4, wherein said second portion includes a generally right-angle bend, and wherein said mounting bracket is an angled mounting bracket.

6. The turbine spline seal of claim 5, wherein said second portion has a mounting guide hole lengthwise disposed between said first portion and said second end.

7. The turbine spline seal of claim 2, wherein said first and second portions include adjoining sections of an imperforate shim-layer assemblage and adjoining sections of a cloth-layer assemblage which generally surrounds and is attached to said shim-layer assemblage, wherein said first portion consists essentially of its corresponding sections of said shim-layer and cloth-layer assemblages, wherein said second portion also includes a mounting bracket lengthwise overlapping the corresponding section of said cloth-layer assemblage of said second portion and attached to the corresponding sections of said cloth-layer and shim-layer assemblages of said second portion, wherein said shim-layer assemblage has a first thickness, wherein said mounting bracket has a second thickness, and wherein said second thickness is at least five times greater than said first thickness.

8. The turbine spline seal of claim 7, wherein said mounting bracket includes a generally right-angle bend.

9. The turbine spline seal of claim 8, wherein said second portion has a mounting guide hole through said mounting bracket and through the corresponding sections of said cloth-layer and shim-layer assemblages of said second portion.

10. The turbine spline seal of claim 9, also including a washer generally coaxially aligned with said mounting guide hole and attached to the corresponding sections of said cloth-layer and shim-layer assemblages of said second portion opposite the attachment of said mounting bracket to the corresponding sections of said cloth-layer and shim-layer assemblages of said second portion.

11. A turbine assembly comprising:

a) a first turbine member having a first surface groove;

b) a second turbine member proximate and spaced apart from said first turbine member so as to define a fluid-path leakage gap therebetween, said second turbine member having a second surface groove facing and generally aligned with said first surface groove; and c) a turbine spline seal including an elongated turbine seal member having a length and a width, having opposing first and second ends bounding said length, and having opposing first and second edges bounding said width, wherein said turbine seal member includes an elongated, imperforate, and manually-flexible first portion, wherein said turbine seal member also includes a manually-rigid second portion lengthwise adjoining said first portion, wherein said first portion is lengthwise disposed between said first end and said second portion, wherein said second portion is lengthwise disposed between said first portion and said second end, wherein said second portion lengthwise extends proximate said second end, wherein said turbine seal member is disposed in said gap with said first edge engaged in said first surface groove and with said second edge engaged in said second surface groove, wherein said turbine spline seal is vibrationally excited within a range of vibrational frequencies by motion of generally only said first and second turbine members during operation of the turbine, wherein said turbine spline seal is devoid of any resonant frequency within said range of vibrational frequencies, and wherein said turbine seal member lacks any manually-flexible portion and any manually-rigid portion which together define an intervening lengthwise-extending gap.

12. The turbine assembly of claim 11, wherein said first portion lengthwise extends proximate said first end.

13. The turbine assembly of claim 12, wherein said first portion has a first thickness and consists essentially of a first section of a metal strip, wherein said second portion has a second thickness and consists essentially of a second section of said metal strip, wherein said second thickness is at least five times greater than said first thickness, wherein said second section lengthwise adjoins said first section, and wherein said metal strip consists essentially of said first and second sections.

14. The turbine assembly of claim 13, also including a third turbine member, wherein said second portion defines a mounting bracket, and wherein said second portion is secured to said third turbine member.

15. The turbine assembly of claim 14, wherein said second portion includes a generally right-angle bend, and wherein said mounting bracket is an angled mounting bracket.

16. The turbine assembly of claim 15, wherein said second portion has a mounting guide hole lengthwise disposed between said first portion and said second end.

17. The turbine assembly of claim 12, also including a third turbine member, wherein said first and second portions include adjoining sections of an imperforate shim-layer assemblage and adjoining sections of a cloth-layer assemblage which generally surrounds and is attached to said shim-layer assemblage, wherein said first portion consists essentially of its corresponding sections of said shim-layer and cloth-layer assemblages, wherein said second portion also includes a mounting bracket lengthwise overlapping the corresponding section of said cloth-layer assemblage of said second portion and attached to the corresponding sections of said cloth-layer and shim-layer assemblages of said second portion, wherein said shim-layer assemblage has a first thickness, wherein said mounting bracket has a second thickness, wherein said second thickness is at least five times greater than said first thickness, and wherein said mounting bracket is secured to said third turbine member.

18. The turbine assembly of claim 17, wherein said mounting bracket includes a generally right-angle bend.

19. The turbine assembly of claim 18, wherein said second portion has a mounting guide hole through said mounting bracket and through the corresponding sections of said cloth-layer and shim-layer assemblages of said second portion, and wherein said turbine spline seal also includes a washer generally coaxially aligned with said mounting guide hole and attached to the corresponding sections of said cloth-layer and shim-layer assemblages of said second portion opposite the attachment of said mounting bracket to the corresponding sections of said cloth-layer and shim-layer assemblages of said second portion.

20. The turbine assembly of claim 19, wherein said turbine assembly is a power-system gas turbine assembly, wherein said first and second turbine members are circumferentially-adjacent transition pieces of said gas turbine assembly, and wherein said third turbine member is a first stage nozzle of said gas turbine assembly.

* * * * *